US009200213B2

(12) United States Patent
Babic-Samardzija et al.

(10) Patent No.: US 9,200,213 B2
(45) Date of Patent: Dec. 1, 2015

(54) METHOD FOR REDUCING ACIDS IN CRUDE OR REFINED HYDROCARBONS

(75) Inventors: Ksenija Babic-Samardzija, Katy, TX (US); Joseph L. Stark, Richmond, TX (US); Michael J. Zetlmeisl, Katy, TX (US); Bradley G. Harrell, Pearland, TX (US); Lawrence N. Kremer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 703 days.

(21) Appl. No.: 12/409,179

(22) Filed: Mar. 23, 2009

(65) Prior Publication Data

US 2009/0236263 A1 Sep. 24, 2009

Related U.S. Application Data

(60) Provisional application No. 61/039,019, filed on Mar. 24, 2008.

(51) Int. Cl.

| | |
|---|---|
| ***C07C 45/00*** | (2006.01) |
| ***C07C 29/06*** | (2006.01) |
| ***C10G 29/06*** | (2006.01) |
| ***C10G 29/08*** | (2006.01) |
| ***C10G 29/16*** | (2006.01) |
| ***C10G 75/00*** | (2006.01) |

(52) U.S. Cl.

CPC ..... *C10G 29/06* (2013.01); *C10G 29/08* (2013.01); *C10G 29/16* (2013.01); *C10G 75/00* (2013.01)

(58) Field of Classification Search

CPC ..... C10G 2300/203
USPC ..... 208/263
See application file for complete search history.

(56) References Cited

U.S. PATENT DOCUMENTS

| | | | | |
|---|---|---|---|---|
| 3,642,607 | A | 2/1972 | Seitzer | |
| 4,021,329 | A | 5/1977 | Seitzer | |
| 4,092,236 | A | 5/1978 | Heredy | |
| 4,163,728 | A * | 8/1979 | Cheng et al. | 508/460 |
| 4,298,450 | A | 11/1981 | Ross et al. | |
| 4,437,980 | A | 3/1984 | Heredy et al. | |
| 4,617,135 | A | 10/1986 | Muir | |
| 5,064,526 | A | 11/1991 | Rogers et al. | |
| 5,288,295 | A | 2/1994 | Hypes et al. | |
| 5,821,202 | A | 10/1998 | Forester et al. | |
| 5,858,208 | A | 1/1999 | Flanders et al. | |
| 5,948,242 | A | 9/1999 | Ohsol et al. | |
| 5,985,137 | A | 11/1999 | Ohsol et al. | |
| 6,054,042 | A * | 4/2000 | Gorbaty et al. | 208/263 |
| 6,547,957 | B1 | 4/2003 | Sudhakar et al. | |
| 6,679,987 | B1 | 1/2004 | Blum et al. | |
| 6,767,452 | B1 * | 7/2004 | Siskin et al. | 208/263 |
| 6,902,662 | B2 | 6/2005 | Eaton et al. | |
| 8,118,994 | B2 * | 2/2012 | Messer et al. | 208/47 |
| 2003/0085157 | A1 * | 5/2003 | Gerhold et al. | 208/263 |
| 2003/0201207 | A1 | 10/2003 | Eaton et al. | |
| 2005/0199530 | A1 | 9/2005 | Stark et al. | |
| 2005/0263439 | A1 | 12/2005 | Stark et al. | |
| 2006/0016723 | A1 | 1/2006 | Tang et al. | |
| 2007/0267327 | A1 | 11/2007 | Boakye | |
| 2008/0001125 | A1 * | 1/2008 | Zetlmeisl et al. | 252/388 |

FOREIGN PATENT DOCUMENTS

| | | | |
|---|---|---|---|
| AU | 693975 | | 7/1998 |
| EP | 0632121 | A2 | 1/1995 |
| GB | 780058 | | 7/1957 |
| WO | 9708270 | A1 | 3/1997 |
| WO | 9708275 | A1 | 3/1997 |
| WO | 03093399 | A1 | 11/2003 |
| WO | WO2006014486 | A1 | 2/2006 |

OTHER PUBLICATIONS

K. A. Gould et al.; "Natural Hydrogen Donors in Petroleum Resids," Energy & Fuels, vol. 21, No. 3, 2007, pp. 1199-1204.

A. Zhang et al.; "Naphthenic acid removal from crude oil through catalytic decarboxylation on magnesium oxide," Applied Catalysts A; General 303 (2006), pp. 103-109.

* cited by examiner

*Primary Examiner* — Ellen McAvoy
(74) *Attorney, Agent, or Firm* — Mossman, Kumar & Tyler, P.C.

(57) ABSTRACT

Total acid number and/or corrosiveness of a crude or refined hydrocarbon, where the total acid number and/or corrosiveness is due to the presence of acid compounds such as carboxylic acid (naphthenic acid), may be reduced by treating the hydrocarbon with a metallic overbase. The effect of this treatment may be substantially enhanced by the presence of a hydrogen transfer agent.

30 Claims, No Drawings

METHOD FOR REDUCING ACIDS IN CRUDE OR REFINED HYDROCARBONS

CROSS REFERENCE TO RELATED APPLICATIONS

This application claims priority from U.S. Provisional Patent Application No. 61/039,019; which was filed on Mar. 24, 2008; and which is fully incorporated herein by reference.

BACKGROUND OF THE INVENTION

1. Field of the Invention

The invention relates to additives useful for reducing the concentration of acids in hydrocarbons. The invention particularly relates to additives useful for reducing the concentration of carboxylic acids in hydrocarbons.

2. Background of the Art

Hydrocarbons, such as crude oil, may contain acids in several forms. These acids may be mineral acids such as hydrochloric, phosphoric, hydrogen sulfide and various oxidized form of hydrogen sulfide such as sulfuric acid. Organic acids are also common in hydrocarbons.

The most common form of organic acids is carboxylic acids. Such acids are characterized by a labile hydrogen associated with an oxygen which itself is adjacent to a carbonyl group. This structure is commonly shown as in the art as having a general formula R—$CO_2$H. While lower molecular weight carboxylic acids may be easily removed from hydrocarbons by washing with dilute bases, higher molecular weight organic acids are not always so easily removed. Also, some carboxylic acids may be produced during refining. Finally, water washes to remove acids may, in some situations, create new problems of greater scope than the carboxylic acids being removed.

Problems caused by carboxylic acids may include corrosion and fouling. Further, when in acid form, carboxylic acids may be easily distilled and thus be found in refined products. It may be desirable in the art of producing or refining hydrocarbons to reduce or eliminate the amount of carboxylic acids from crude and refined hydrocarbons using an additive.

SUMMARY OF THE INVENTION

In one aspect, the invention is a process for preparing a refined hydrocarbon including: 1) treating a crude hydrocarbon having a carboxylic acid concentration such that a refined hydrocarbon produced therewith exceeds a predetermined specification for a property affected by the presence of a carboxylic acid with a metallic overbase additive; and 2) refining the crude hydrocarbon to produce at least one refined hydrocarbon, wherein the at least one refined hydrocarbon meets the predetermined specification for a property affected by the presence of a carboxylic acid.

In another aspect, the invention is a process for treating a hydrocarbon to reduce carboxylic acids concentration, the process including admixing the hydrocarbon with a metallic overbase and a hydrogen transfer agent.

In another aspect, the invention is a low acid hydrocarbon including a hydrocarbon treated by admixing the hydrocarbon with a metallic overbase and a hydrogen transfer agent, wherein the metallic overbase and a hydrogen transfer agent remain in the low acid hydrocarbon.

In still another aspect, the invention is a composition useful for treating a hydrocarbon to reduce the level of carboxylic acids therein including a metallic overbase and hydrogen transfer agent.

DESCRIPTION OF THE PREFERRED EMBODIMENTS

In the practice of an embodiment of a process of this application, a crude hydrocarbon having a carboxylic acid concentration such that a refined hydrocarbon produced therewith exceeds a predetermined specification for a property affected by the presence of a carboxylic acid is treated with a metallic overbase. The crude hydrocarbon, in one embodiment, may be very "crude" and be, for example, crude oil. In another embodiment, the crude hydrocarbon may only be "crude" in regard to a subsequent refining step. For example, in one embodiment, the process may be a refining step to produce light hydrocarbon fuels such as gasoline or aviation fuel. In refineries, the feed streams for such units have already undergone at least one step to remove components that are not desirable for producing such fuels. Thus, in this embodiment, the feed stream to this unit is a crude hydrocarbon even though it has had at least one refining process step performed upon it.

The hydrocarbons to be treated using the methods of the application, whether crude or refined, may have low levels of water. In some applications, water may be undesirable because it may consume or render some metallic overbases ineffective. Hydrocarbons that are essentially water free may be treated according to the method of the application. In some applications, the hydrocarbon to be treated may have up to 1 percent, by weight, water present and still be treatable. In other applications, the hydrocarbon may have up to 2 percent water present and still be treatable. Where the hydrocarbon has more than 2 percent water present, then additional amounts of metallic overbase may be required to compensate or the hydrocarbon may be subjected to a process to remove water.

Embodiments of some of the processes of the disclosure may include a refining step. Refining steps which may be useful with these processes include, but are not limited to, distillation, vacuum distillation, steam distillation, heat treating, and solvent extractions. Refining equipment that may be used with the processes of the disclosure include FCC towers and transfer lines, coker furnace tubes and transfer lines, and the like. In embodiments where the refining step is a distillation, of any kind, the additive is most often used to treat the crude hydrocarbon prior to the distillation, but in at least some embodiments, the additive may be introduced into a vaporous stream such as the vaporous overhead of a distillation process.

In embodiments where the refining step is other than a distillation, the refined hydrocarbon can be the crude hydrocarbon feedstock after the refining step is performed. For example, a crude hydrocarbon that is treated according to an embodiment of the process of the application may produce a single refined hydrocarbon by heat treating a crude hydrocarbon in the presence of a metallic overbase additive.

In still other embodiments of the process of the application, a crude hydrocarbon may be treated to produce two or more refined hydrocarbons. For example, a crude hydrocarbon feed to a distillation unit may be treated to produce a first overhead product having a reduced TAN (Total Acid Number, mg KOH/g oil) and a distillation residue that meets a corrosion specification. This is particularly useful in applications where the crude hydrocarbon is going to be further treated using a process which could be adversely affected by alternative chemistries. For example, phosphates can be undesirable in some applications where the metallic overbases disclosed in this application would not be so undesirable.

In some embodiments of the application, a refined hydrocarbon has a predetermined specification for a property affected by the presence of a carboxylic acid. Examples of such properties include, but are not limited to, TAN and corrosiveness. In one specific application, aviation fuel, such as JP-6, is often specified by end-users to have a TAN not to exceed a specific value. For example, the TAN may be specified not to exceed 0.1 as in ASTM 1655. In one hypothetical embodiment of a process of the application, the feed to a unit producing JP-6 by means of distillation is producing distillates and/or overheads that otherwise meet the specifications of JP-6 except that the TAN is too high. A metallic overbase additive of the application is admixed with the feed to the unit prior to the distillation and the resulting JP-6 produced has a TAN that is within the specification for JP-6.

In the practice of the methods of the application, a crude hydrocarbon having a carboxylic acid concentration is treated with an additive. For the purposes of this application, the term carboxylic acid includes both the protonated and non-protonated form of the compounds. One commonly occurring type of carboxylic acids that may be treated with embodiments of the process of the application is naphthenic acids. Naphthenic acids are commonly known in the art of refining crude oil. Because of their high molecular weight and hydrophobic nature, they are often difficult to separate from crude oil using conventional technology that is often effective for removing lower molecular weigh carboxylic acids. While carboxylic acids such as naphthenic acid may be treated using the method of the application, these methods are also effective for treating hydrocarbons having other carboxylic acids present. The methods of the application may be used to treat any carboxylic acid that may be present in a crude hydrocarbon.

In one embodiment, the invention includes an additive containing a metallic overbase. For the purposes of this disclosure the term metallic, as used with metallic overbases, means having one or more of: beryllium, magnesium, calcium, strontium, barium, scandium, yttrium, lanthanide, actinide, boron, aluminum, gallium, indium, and thallium. Thus, the overbases useful with this application may include any one or more of these, such as for example, a magnesium overbase which has magnesium being the only metal present at material concentrations. Embodiments of the application include, for example, additives having a magnesium overbase component or an aluminum overbase component or a mixed magnesium-aluminum overbase component, and the like. Other embodiments may have, for example, a calcium overbase component or a barium overbase component.

In one embodiment, the metallic overbase useful with method of the disclosure is a magnesium overbase and/or a magnesium-aluminum overbase. The terms "overbase" and "overbases" refers to compounds with a great capacity of neutralizing acids. The term(s) aluminum and magnesium overbases mean that the subject metallic overbases contain atoms of these metals. The metallic overbase component of the additives used with the application may be prepared in any manner known to those of ordinary skill in the art for preparing such overbases to be useful.

In one embodiment, the metallic overbase is a magnesium oxide/magnesium carboxylated overbase complex. This overbase is desirably in the form of finely divided, preferably submicron (no dimension greater than 1 micron), particles which can form a stable dispersion in a hydrocarbon. One method of preparing such a magnesium oxide/magnesium carboxylated overbase complex is to form a mixture of a base of the desired metal; e.g., $Mg(OH)_2$, as a complexing agent; e.g., a fatty acid such as a tall oil fatty acid, which is present in a quantity much less than that required to stoichiometrically react with the hydroxide, and a non-volatile diluent. The mixture is heated to a temperature of about 250 to 350° C. to produce the overbase complex of the metal oxide and metal salt of the fatty acid.

Such process are known in the prior art. For example, the process of U.S. Pat. No. 4,163,728, which is fully incorporated herein by reference, may be used. Therein, it is disclosed that a magnesium carboxylate can be prepared using a process employing minor percentages of stoichiometric amounts of carboxylic acid such as less than about 50% of the calculated stoichiometric amount. In this process, any suitable carboxylic acid at low stoichiometry can be employed. These include mono- and polycarboxylic acids including aliphatic, aromatic, and cycloaliphatic, carboxylic acids. Representative examples include: formic acid, acetic acid, propionic acid, butyric acid, acrylic acid, maleic acid, and the like.

Any suitable magnesium carboxylate capable of being subdivided upon decomposition into submicron particles of magnesia can be employed in the magnesium carboxylate-magnesium hydroxide mixture. Magnesium acetate is an exemplary starting magnesium carboxylate compound in such a mixture whether starting as the anhydrous solid, hydrated solid or aqueous slurry or as magnesium carboxylate formed in situ. The magnesium overbases acceptable for the method of this invention may also include overbase compounds where a carbonation procedure has been done. Typically, the carbonation involves the addition of $CO_2$, as is well known in the art.

Any suitable non-volatile process fluid capable of being heated to the decomposition temperature of, for example, a magnesium carboxylate-magnesium hydroxide mixture can be employed. The process fluid should be relatively stable and relatively non-volatile at the decomposition temperature. However, any volatility encountered may be readily controlled by using a refluxing and condensing apparatus. Examples of such non-volatile process fluids are as follows: hydrocarbons (such as mineral oil, paraffin oil, or aromatic oil), diphenyl oxide fluids, silicone oils, polyglycol ethers or vegetable oils, etc., solely the dispersant, or any combinations thereof.

In some embodiments, the non-volatile process fluid may contain at least one dispersant capable of retaining the magnesium compound formed by decomposition in stable suspension. Any suitable dispersant which is relatively stable under the decomposition conditions may be employed. Exemplary dispersants include saturated and unsaturated fatty acids (such as stearic acid and oleic acid) and derivatives thereof (such as sorbitan mono-oleate), sulfonic acids (such as mahogany or petroleum derived sulfonic acids and synthetic sulfonic acids), naphthenic acids, oxyalkylated fatty amines, alkylphenols, sulfurized alkylphenols, oxyalkylated alkylphenols, and the like.

Similarly, the aluminum overbases useful with the invention may be made using any method known to those of ordinary skill in the art of preparing such compounds to be useful. For example, in one process to make an aluminum overbase, dodecylbenzene sulfonic acid is admixed with kerosene and isobutanol to form a first solution. The first solution is then acidified with a nitric acid and then admixed with alumina. This solution is then subject to distillation to remove water and solvent resulting in an aluminum sulfonic acid overbase.

The other metals useful in preparing the metallic overbases are used to form overbases in a similar fashion. The metallic overbases useful with the application may also be prepared using other synthetic routes. Whether made by the same method with substitution of the appropriate cation, such as Ca for Mg, or made via a different route, the overbases may be used with embodiments of the invention. In most embodiments, the metallic overbase may be a metallic carboxylate, oxide, carbonate, and combinations thereof.

In one embodiment of the invention, the additives include a magnesium overbase and an aluminum overbase. When the additive includes such a magnesium aluminum overbase, the two components may be present in the additive at a weight concentration of each metal [Mg:Al] of from about 1:99 to about 99:1. In one embodiment, the ratio of Mg:Al is from 90:10 to 10:90. In still another embodiment, the ratio of Mg:Al is from about 80:20 to about 20:80. In yet another embodiment the ratio of Mg:Al is from about 70:30 to about 30:70, or about 60:40 to about 40:60. These ratios may also be used with other metal combinations, such as Mg:B and/or Al:Y.

The total feed rate of the additive will generally be determined by the operator of the specific process unit to be subject to treatment using the additive. Those of ordinary skill in the art in operating such a unit will know how to make such determinations based upon the specific operating parameters of their production units. Nevertheless, in some embodiments, the feed range of the additives will be from about 10 to 10,000 ppm by weight of the additive in the process stream being treated. In other embodiments, the feed range will be from about 100 to 1,000 ppm. In still other embodiments, the feed range will be from about 200 to about 800 ppm.

The additives of the application may be introduced into their target feed material in any way known to be useful to those of ordinary skill in the art subject to the caveat that the additives are introduced prior to or concurrent with the a refining process. For example, in one application, the additive is injected into the feed material upstream from a refining unit as the feed material passes through a turbulent section of piping. In another application, the additive is admixed with the feed material in a holding vessel that is agitated. In still another application, the additive is admixed with the feed immediately upstream of a refining unit by injecting the additive into a turbulent flow, the turbulent flow being created by static mixers put into place for the purpose of admixing the additive with a feed material. In still another embodiment, the additive is atomized and fed into a vaporous feed stream using, for example, an injection quill.

While not wishing to bound by any theories, it is believed that the metallic overbase additives of the present invention interact with the acid groups of the carboxylic acids and convert them to another, less acidic, chemical group.

The effect of the metallic overbase additives of the application may, in some applications, be enhanced using hydrogen transfer agents. Exemplary hydrogen transfer agents include, but are not limited to:

1,2,3,4-tetrahydronaphthalene (TETRALIN®);
1,2,3,4-tetrahydrdroquinoline;
9,10-dihydroanthracene;
9,10-dihydrophenanthrene;

and the like. Any compound known to function as a hydrogen transfer agent in a hydrocarbon to be useful may be used with some of the embodiments of the process of the application.

For example, hydrogen donors that can function as hydrogen transfer agents of the application may be determined using a test method offered forth in the article, NATURAL HYDROGEN DONORS IN PETROLEUM RESIDS, Gould & Wiehe, 21 Energy & Fuels, pp 1199-1204 (2007), which is fully incorporated herein by reference. In this test, 2,3-dichloro-5,6-dicyano-p-benzoquinone is contacted with target compounds to determine whether the target compounds can be a donor for the hydrogens necessary to produce a hydroquinone. Any compound that can act as a hydrogen donor may be useful with at least some embodiments of the application.

Still, not all hydrogen donors may be equivalent. While not wishing to be bound by any theory, it is believed that the hydrogen donors, to be effective, may be smaller and of low molecular weight. For example, some of the "resids," that is heavy molecular weight residues from the refining of crude oil are shown to be hydrogen donors in the Gould & Wiehe article. In some embodiments of the invention, the resids may be used, but in others, smaller molecules such as those listed above may be more effective and easier to handle.

In some embodiments, the metallic overbases are dispersed within a solvent that also includes a hydrogen transfer agent. When a hydrogen transfer agent present, then in some embodiments, the hydrogen transfer agent is present in a ratio, by weight, of hydrogen transfer agent to metallic overbase of from 1:99 to 99:1. In other embodiments, the ratio is from about 1:19 to 19:1, and in still other embodiments, the ratio is from about 1:9 to about 9:1. In at least one embodiment, the ratio is from about 1:3 to 3:1 and in others, it is from about 1:2 to 2:1.

In some embodiments of the method of the application, the use of a hydrogen transfer agent enhances the decarboxylation effect of a metallic overbase. The amount of metallic overbase and hydrogen transfer agent used to treat a hydrocarbon will vary as a function of the concentration of carboxylic acids present and the amount of desired acidity reduction. One of ordinary skill in the art would know how to test to determine the optimum levels of any additive, including those of this application, for use in producing or refining hydrocarbons. Still, in some application, the amount of metallic overbase and hydrogen transfer agent added to the hydrocarbon will be from about 5 to about 2000 ppm by weight. In some applications, the amount will be from about 25 to 1000 ppm. In still other applications, the amount will be from about 50 to about 750 ppm.

In embodiments of the method of the invention, the additive and the hydrocarbon may be treated for a time sufficient to reach a desired level of acidity reduction. In many embodiments, this period may be very short, measure in seconds or a few minutes. In a few embodiments, this may be up to 20 hours. In other embodiments, this period may be up to about 10 hours. In still other embodiments, this period may be up to about 2 hours.

The presence of carboxylic acids in hydrocarbons may be problematic at every point of the life span of the hydrocarbon. For example, in formation fluid, that is the crude oil produced directly from an oil well, carboxylic acids may contribute to corrosion which can cause costly damage or require the use of corrosion inhibitors. They may also cause entrained solids which can require costly treatments before the hydrocarbon can be refined, or in some embodiments, even shipped in a pipeline. The acids can lead to the formation of gums and act as a catalyst to cause fouling in heaters. It may also cause color to be present in products that have low color specifications. During refining, these acids may cause water to go into overhead streams where water is undesirable. In some instance, these acids may cause chlorides to go overhead as well.

It follows then that it may be desirable to reduce or mitigate the amount of carboxylic acids in hydrocarbons as early as at the wellhead or even during the collection and/or transportation of, for example crude oil, to a refinery. The metallic overbases and hydrogen transfer agents of the invention may be used at any point where the hydrocarbon stream is dry enough to be effectively treated and the temperature is at least 100° F. (38° C.). In some embodiments, the temperature is at least 200° F. (93° C.) and in other embodiments, the temperature is at lease 300° F. (149° C.). For example, the method of the application may be practiced in a topping unit at a crude oil collection point. A "slop oil heater" is often used to drive off water in crude oil to meet pipeline specifications and they typically heat oil to a temperature of from about 150° F. (66° C.) to about 200° F. (93° C.). Such an apparatus could be used with the method of the application.

U.S. Pat. No. 5,948,242 to Ohsol, et al., which is fully incorporated herein by reference, describes a process for upgrading crude oil in or near an oil field. The additives and methods of the application may be used with such a process to upgrade the value of oil processed therein by reducing the acidity of the oil.

The additives of the application may include a metallic overbase, a mixture of a metallic overbase and a hydrogen transport agent, a further mixture of either with a solvent, and any of the proceeding additionally including other compounds such as corrosion inhibitors and the like. These additives may be prepared in any way known to be useful to those of ordinary skill in the art of prepared such compositions. In some embodiments of the processes of the disclosure, the additives are contained in a single container when shipped to a customer and in others some of the components may be segregated when shipped and then combined at the time of use.

In some embodiments, the additives of the disclosure may consist essentially of a metallic overbase and a hydrogen transport agent. In other embodiments, the additives may consist of a solvent and metallic overbase and a hydrogen transport agent. In these embodiments, the additives would have no more than 5 percent by weight of other components.

The additive of the application may be present at a material concentration, namely a concentration that is sufficient to reduce the acidity of a hydrocarbon by at least 5 percent based upon total acid number. In other embodiments the material concentration of the additive is sufficient to reduce the acidity of a hydrocarbon by at least 10 percent based upon total acid number. In other embodiments the material concentration of the additive is sufficient to reduce the acidity of a hydrocarbon by at least 25 percent based upon total acid number.

EXAMPLES

The following examples are provided to illustrate the invention. The examples are not intended to limit the scope of the invention and they should not be so interpreted. Amounts are in weight parts or weight percentages unless otherwise indicated.

Example 1

A gas mixture containing nitrogen and 1% $H_2S$ was sparged into mineral oil in a 0.5 liter resin reaction kettle, hereinafter referred to as a kettle. Two test C1018 cylindrical carbon steel coupons were used to test for corrosion. The coupons were prepared for testing by bead blasting.

The mineral oil in the kettle was mixed with a sufficient amount of commercially available naphthenic acids to produce a TAN (Total Acid Number, mg KOH/g of oil) of 13 (as determined by analyzing a blank control).

The rate of corrosion is 40.7 mpy in untreated mineral oil.

The mineral oil in the kettle is then treated with aluminum/magnesium carboxylate overbases at a concentration of about 2000 ppm. The kettle is heated at 550° F. (288° C.) for 20 hours with stirring. The coupons are retrieved and compared with an coupon from untreated mineral oil. The rate of corrosion observed is 10.9 mpy (milli-inch per year). The mineral oil is tested for acid number and the result is 10.5.

Example 2

A gas mixture containing nitrogen and 1% $H_2S$ was sparged into mineral oil in a testing container commonly referred to as a kettle. Two test C1018 cylindrical carbon steel coupons were used to test for corrosion. The coupons were prepared for testing by bead blasting.

The mineral oil in the kettle was treated with sufficient naphthenic acid to produce a total acid number of 13 (as determined by analyzing a blank control).

The mineral oil in the kettle is then treated with a magnesium carboxylate overbase (prepared using tall oil fatty acids). The metallic overbase additive is used with TETRALIN, a hydrogen transfer agent at a concentration of about 2000 ppm. The kettle is heated at 550° F. (288° C.) for 20 hours with stirring. The coupons are retrieved and compared with an untreated coupon. The rate of corrosion 4.8 mpy. The mineral oil is tested for total acid number and the result is 2.28.

Example 3

The mineral oil used in Example 1 and Example 2 is tested before and after the experiment by measuring the infra-red absorbance spectrum of the samples using an FT-IR. The treated sample in Example 1 showed a substantially reduced absorbance, as compared to the untreated sample, at 1703 $cm^{-1}$, and 935 $cm^{-1}$. The treated sample in Example 2 showed the carbonyl peak at 1703 $cm^{-1}$ eliminated and the out-of-plane carboxylic acid hydroxyl bending absorbance at 934 $cm^{-1}$ reduced nearly to baseline.

Example 4

A gas mixture containing nitrogen and 1% $H_2S$ was sparged into Heavy Vacuum Gas Oil (HVGO) in a testing container commonly referred to as a kettle. Two test C1018 cylindrical carbon steel coupons were used to test for corrosion. The coupons were prepared for testing by bead blasting.

The TAN of untreated HVGO was 4.96.

The field sample of HVGO in the kettle is then treated with an additive: a metallic overbase additive with hydrogen transfer agent, TETRALIN, at the concentration of about 2000 ppm. The kettle is heated at 550° F. (288° C.) for 20 hours with stirring. After experiment the HVGO is tested for TAN and has a value of 2.21.

Example 5

A gas mixture containing nitrogen and 1% $H_2S$ was sparged into mineral oil in a testing container commonly referred to as a kettle. Two test C1018 cylindrical carbon steel coupons were used to test for corrosion. The coupons were prepared for testing by bead blasting.

The mineral oil in the kettle was mixed with sufficient amount of commercially available naphthenic acids to produce a total acid number of 13.9 (as determined by analyzing a blank control). The rate of corrosion is 29.5 mpy.

The mineral oil in the kettle is then treated with a magnesium carboxylate overbase (prepared using tall oil fatty acids). The metallic overbase additive is used with TETRALINe, a hydrogen transfer agent and sulfur based corrosion inhibitor, at a concentration of about 2000 ppm. The kettle is heated at 550° F. (288° C.) for 20 hours with stirring. The coupons are retrieved and compared with an untreated coupon. The rate of corrosion 6.12 mpy. The mineral oil is tested for TAN and the result is 5.69.

Example 5

A gas mixture containing nitrogen and 1% $H_2S$ was sparged into mineral oil in a testing container commonly referred to as a kettle. Two test C1018 cylindrical carbon steel coupons were used to test for corrosion. The coupons were prepared for testing by bead blasting.

Field sample of HVGO with total acid number of 1.57 (as determined by analyzing a blank control) was analyzed. The rate of corrosion is determined to be 8.8 mpy.

Field HVGO sample was then treated with a magnesium carboxylate overbase (prepared using tall oil fatty acids). The metallic overbase additive is used with TETRALIN, a hydrogen transfer agent and sulfur based corrosion inhibitor, at a concentration of about 2000 ppm. The kettle is heated at 550° F. (288° C.) for 20 hours with stirring. The coupons are retrieved and compared with an untreated coupon. No corrosion observed on metal surface. The mineral oil acidity is resulted as TAN of 0.68.

Example 6

Mineral oil was prepared to have a TAN of 1 using commercial naphthenic acids. The sample was then treated with 350 ppm of a mixture of a magnesium carboxylate overbase and TETRALIN, a hydrogen transfer agent, at a ratio of 6:1; at several temperatures and the TAN of the treated samples noted below in Table 1.

Example 7

Samples of mineral oil were combined with commercial naphthenic acids. Field HVGO is used as received without any pretreatment. The samples were heated to 550° F. (288° C.) for 20 hours with a mixture of a magnesium carboxylate overbase and TETRALIN, a hydrogen transfer agent. The samples were continuously sparged with 1% $H_2S$ in nitrogen except where noted. The TANs were noted for each sample before treatment, after sparging and heating with no additive, and after sparging and heating with the additive.

Example 8

Crude oil is tested for TAN and then subjected to a distillation using ASTM D86. The crude oil is treated with 125 ppm of an additive which is an admixture of a magnesium carboxylate overbase and TETRALIN at a ratio of 9:1. Kerosene and a diesel fraction are produced and tested for TAN. The data is noted below in Table 3.

Example 9

The synergistic effect of admixing a metallic overbase with a hydrogen transfer agent is shown by testing each component alone and then in combination. HVGO oil and mineral oil is treated with a magnesium carboxylate overbase and TETRALIN at 550° F. (288° C.) for 20 hours. The TAN numbers are shown below in Table 4.

Discussion of Examples

The examples show that the metallic overbase additive(s) was able to reduce the acidity of oil and the rate of corrosion. Also noted is a reduction of the peaks associated with carbonyl group (C═O) and the out-of-plane carboxylic acid hydroxyl (O—H) bending absorbance. The examples also show that the use of a hydrogen transfer agent may substantially enhance the effect of the metallic overbases at reducing acidity.

TABLE 1

| Temperature (° F./° C.) | TAN |
|---|---|
| 70/21 | 1 |
| 150/66 | 0.87 |
| 250/121 | 0.63 |
| 350/177 | 0.47 |
| 450/232 | 0.45 |
| 550/288 | 0.45 |

TABLE 2

| Sample | Gas purge | Overbase ppm | Hydrogen Transfer Agent ppm | TAN before treatment | TAN after treatment no additive | TAN after treatment with additive |
|---|---|---|---|---|---|---|
| HVGO | H2S | 1600 | 200 | 4.96 | 3.28 | 2.21 |
| HVGO | H2S | 900 | 100 | 1.57 | 1.26 | 0.62 |
| HVGO | N2 | 900 | 100 | 1.57 | 1.26 | 0.84 |
| Mineral Oil/Nap acids | H2S | 300 | 50 | 0.33 | na | 0.09 |
| Mineral Oil/Nap acids | H2S | 300 | 50 | 0.50 | na | 0.17 |
| Mineral Oil/Nap acids | H2S | 300 | 50 | 2.12 | na | 0.96 |
| Mineral Oil/Nap acids | H2S | 1600 | 400 | 13.7 | 10.6 | 2.28 |
| Mineral Oil/Nap acids | H2S | 1600 | 400 | 13.9 | 13.8 | 5.69 |

TABLE 3

| Sample | Distillate | TAN (mgKOH/g oil) before treatment | TAN (mgKOH/g oil) after treatment with additive |
|---|---|---|---|
| Crude Oil | Kerosene | 0.11 | <0.05 |
| Crude Oil | Diesel | 0.28 | <0.05 |

TABLE 4

| Sample | Gas purge | Overbase ppm | Hydrogen Transfer Agent ppm | TAN before treatment | TAN after treatment with additive |
|---|---|---|---|---|---|
| Mineral Oil/Nap acids | H2S | 1500 | xx | 13.9 | 10.9 |
| Mineral Oil/Nap acids | H2S | xx | 2000 | | 8.64 |
| Mineral Oil/Nap acids | H2S | 1600 | 400 | | 2.28 |
| HVGO | H2S | 1000 | xx | 1.57 | 0.82 |
| HVGO | H2S | xx | 1000 | | 1.28 |
| HVGO | H2S | 900 | 100 | | 0.76 |

What is claimed is:

1. A process for treating a hydrocarbon to reduce carboxylic acids concentration comprising admixing the hydrocarbon with an additive comprising a metallic overbase and a hydrogen transfer agent; wherein the temperature of the hydrocarbon ranges from about 100° F. (38° C.) to about 300° F. (149° C.).

2. The process of claim 1 wherein the metallic overbase is selected from the group consisting of a magnesium overbase, an aluminum overbase, and combinations thereof.

3. The process of claim 1 wherein the metallic overbase is selected from the group consisting of a carboxylate overbase, an oxide overbase, a carbonate overbase and mixtures thereof.

4. The process of claim 1 wherein the hydrogen transfer agent is selected from the group consisting of: 1,2,3,4-tetrahydronaphthalene; 1,2,3,4-tetrahydrdroquinoline, 9,10-dihydroanthracene; 9,10-dihydrophenanthrene, and combinations thereof.

5. The process of claim 1 wherein the hydrocarbon is crude oil.

6. The process of claim 5 wherein the crude oil has less than 2 percent by weight water present.

7. The process of claim 5 wherein the process is practiced prior to introducing the hydrocarbon into a pipeline.

8. The process of claim 5 wherein the process is practiced within a unit selected from the group consisting of a slop oil heater or a topping unit.

9. The process of claim 1 wherein the hydrocarbon is a feed stream to a distillation unit.

10. The process of claim 9 wherein the distillation unit is used to produce fuel.

11. The process of claim 1 wherein the additive is present in the hydrocarbon at a concentration of metallic overbase and hydrogen transport agent of from about 5 to about 2,000 ppm by weight.

12. The process of claim 11 wherein the additive is present in the hydrocarbon at a concentration of metallic overbase and hydrogen transport agent of from about 25 to about 1,000 ppm by weight.

13. The process of claim 12 wherein the additive is present in the hydrocarbon at a concentration of metallic overbase and hydrogen transport agent of from about 50 to about 750 ppm by weight.

14. The process of claim 1 wherein the hydrocarbon and additive are heated to at least 100° F. (38° C.).

15. The process of claim 14 wherein the hydrocarbon and additive are heated to at least 200° F. (93° C.).

16. The process of claim 15 wherein the hydrocarbon and additive are heated to at least 300° F. (149° C.).

17. The process of claim 1 wherein the hydrocarbon and the additive are heated for up to 20 hours.

18. A low acid hydrocarbon comprising a hydrocarbon, a metallic overbase and a hydrogen transfer agent, wherein compounds remaining in the low acid hydrocarbon are selected from the group consisting of the metallic overbase, the hydrogen transfer agent, and compounds resulting therefrom; wherein the temperature of the hydrocarbon ranges from about 100° F. (38° C.) to about 300° F. (149° C.).

19. The hydrocarbon of claim 18 wherein the metallic overbase is selected from the group consisting of a magnesium overbase, an aluminum overbase, and combinations thereof.

20. The hydrocarbon of claim 18 wherein the metallic overbase is a selected from the group consisting of a carboxylate overbase, an oxide overbase, a carbonate overbase and mixtures thereof.

21. The hydrocarbon of claim 18 wherein the hydrogen transfer agent is selected from the group consisting of: 1,2,3,4-tetrahydronaphthalene; 1,2,3,4-tetrahydrdroquinoline; 9,10-dihydroanthracene, 9,10-dihydrophenanthrene, and combinations thereof.

22. The hydrocarbon of claim 18 wherein the hydrocarbon treated is crude oil.

23. An additive useful for treating a hydrocarbon to reduce the level of carboxylic acids therein, the additive comprising a metallic overbase and hydrogen transfer agent; wherein the metallic overbase comprises particles having no dimension greater than 1 micron.

24. The additive of claim 23 wherein the metallic overbase is selected from the group consisting of a magnesium overbase, an aluminum overbase, and combinations thereof.

25. The additive of claim 23 wherein the metallic overbase is a selected from the group consisting of a carboxylate overbase, an oxide overbase, a carbonate overbase and mixtures thereof.

26. The additive of claim 23 wherein the hydrogen transfer agent is selected from the group consisting of: 1,2,3,4-tetrahydronaphthalene; 1,2,3,4-tetrahydrdroquinoline, 9,10-dihydroanthracene; 9,10-dihydrophenanthrene, and combinations thereof.

27. The additive of claim 23 wherein the ratio between the metallic overbase and the hydrogen transport agent is from about 99:1 to about 1:99.

28. The additive of claim 23 wherein the ratio between the metallic overbase and the hydrogen transport agent is from about 19:1 to about 1:19.

29. The additive of claim 23 wherein the ratio between the metallic overbase and the hydrogen transport agent is from about 9:1 to about 1:9.

30. The additive of claim 23 wherein the ratio between the metallic overbase and the hydrogen transport agent is from about 2:1 to about 1:2.

* * * * *